US009730480B2

(12) United States Patent
Kim et al.

(10) Patent No.: US 9,730,480 B2
(45) Date of Patent: Aug. 15, 2017

(54) FABRIC FLOWER MAKER

(71) Applicants: Jin Kim, Rolling Meadows, IL (US); Leona Kim, Rolling Meadows, IL (US)

(72) Inventors: Jin Kim, Rolling Meadows, IL (US); Leona Kim, Rolling Meadows, IL (US)

( * ) Notice: Subject to any disclaimer, the term of this patent is extended or adjusted under 35 U.S.C. 154(b) by 367 days.

(21) Appl. No.: 14/515,381

(22) Filed: Oct. 15, 2014

(65) Prior Publication Data

US 2015/0104589 A1 Apr. 16, 2015

Related U.S. Application Data

(60) Provisional application No. 61/891,719, filed on Oct. 16, 2013.

(51) Int. Cl.
*B65D 71/00* (2006.01)
*A41G 1/02* (2006.01)

(52) U.S. Cl.
CPC ..... *A41G 1/02* (2013.01); *Y10T 29/49826* (2015.01)

(58) Field of Classification Search
CPC ..... A41G 1/02
USPC ..... 206/423, 575; 47/41.01, 41.11; 428/17, 428/24
See application file for complete search history.

(56) References Cited

U.S. PATENT DOCUMENTS 1,879,677 A 9/1932 Gockel
2,686,989 A * 8/1954 Dillon ..... A01G 5/00 47/41.13
2,692,449 A 10/1954 Jones
3,002,308 A * 10/1961 Decamp ..... A41G 1/00 206/423
3,169,897 A * 2/1965 Yue ..... A47G 7/07 428/27
3,309,001 A * 3/1967 Thayer ..... A41G 1/02 223/46
4,892,515 A 1/1990 Stiegler
5,375,370 A * 12/1994 Zimmerman ..... A47G 7/07 248/188
5,380,568 A * 1/1995 Banschick ..... A01G 5/04 211/13.1
5,545,274 A 8/1996 Rosenthal
5,698,275 A 12/1997 Pompeo
7,096,623 B2 * 8/2006 Cardamone ..... A47G 7/07 47/41.01
8,069,609 B1 * 12/2011 Towne ..... A01G 5/04 206/423

(Continued)

OTHER PUBLICATIONS

International Search Report and Written Opinion dated Mar. 3, 2015, for PCT Application No. PCT/US2014/060756.

*Primary Examiner* — Luan K Bui
(74) *Attorney, Agent, or Firm* — Neal, Gerber & Eisenberg LLP

(57) ABSTRACT

An artificial flower maker including a board or other flat surface, a plurality of arms each positioned along the flat surface and forming a generally circular shape, and a center attachment mechanism for constructing and securing an artificial flower. Each flower is constructed by strategically folding a series of petals from a type of material, and using the artificial flower maker to hold down each folded petal until all folded petals are completed and ultimately secured to form an artificial flower. A further embodiment may incorporate a box or other enclosure for storage and transport of the flower maker.

18 Claims, 16 Drawing Sheets

(56) References Cited

U.S. PATENT DOCUMENTS

| | | | | |
|---|---|---|---|---|
| 8,438,780 | B1 | 5/2013 | Malavenda | |
| 9,244,598 | B1 * | 1/2016 | David | G06F 3/0484 |
| 2003/0177741 | A1 | 9/2003 | Fantz et al. | |
| 2005/0072044 | A1 | 4/2005 | Van Zuylen | |

* cited by examiner

FABRIC FLOWER MAKER

CROSS-REFERENCE TO RELATED APPLICATION

This application claims priority to U.S. Provisional Patent Application No. 61/891,719, filed on Oct. 16, 2013, the content of which is fully incorporated herein by reference.

BACKGROUND OF THE INVENTION

This invention generally relates to an artificial flower maker. Artificial flower making is a craft that has gained a lot of popularity. Many flower making kits on the market are designed for adults and contain a needle and thread, which can be difficult and dangerous for children. Some of these flower making kits require each petal of the flower to be sewn to the other petals of the flower, which can be time consuming. Other flower making kits require each piece of fabric to be glued together to secure the flower, which can be difficult and messy for children.

SUMMARY OF THE INVENTION

The present disclosure is generally directed to a device for constructing and securing an artificial flower from fabric. The present disclosure generally includes a board or other flat surface with a plurality of arms to hold down flower petals while constructing the flower, and a central attachment mechanism to secure the petals together to complete the flower.

In one embodiment of the present disclosure, the artificial flower maker includes a board or other flat surface, a plurality of arms each positioned along the flat surface and forming a generally circular shape, and a center attachment mechanism for constructing and securing an artificial flower. Each flower is constructed by strategically folding a series of petals from a type of material, and using the artificial flower maker to hold down each folded petal until all folded petals are completed and ultimately secured to form an artificial flower. The material for each petal may include fabric, foam, felt, or a variety of other foldable materials. A further embodiment may incorporate a box for storage and transport of the flower maker.

A better understanding of the invention will be obtained from the following detailed descriptions and accompanying drawings, which set forth illustrative embodiments that are indicative of the various ways in which the principals of the invention may be employed.

DETAILED DESCRIPTION OF THE DRAWINGS

Figure 1:
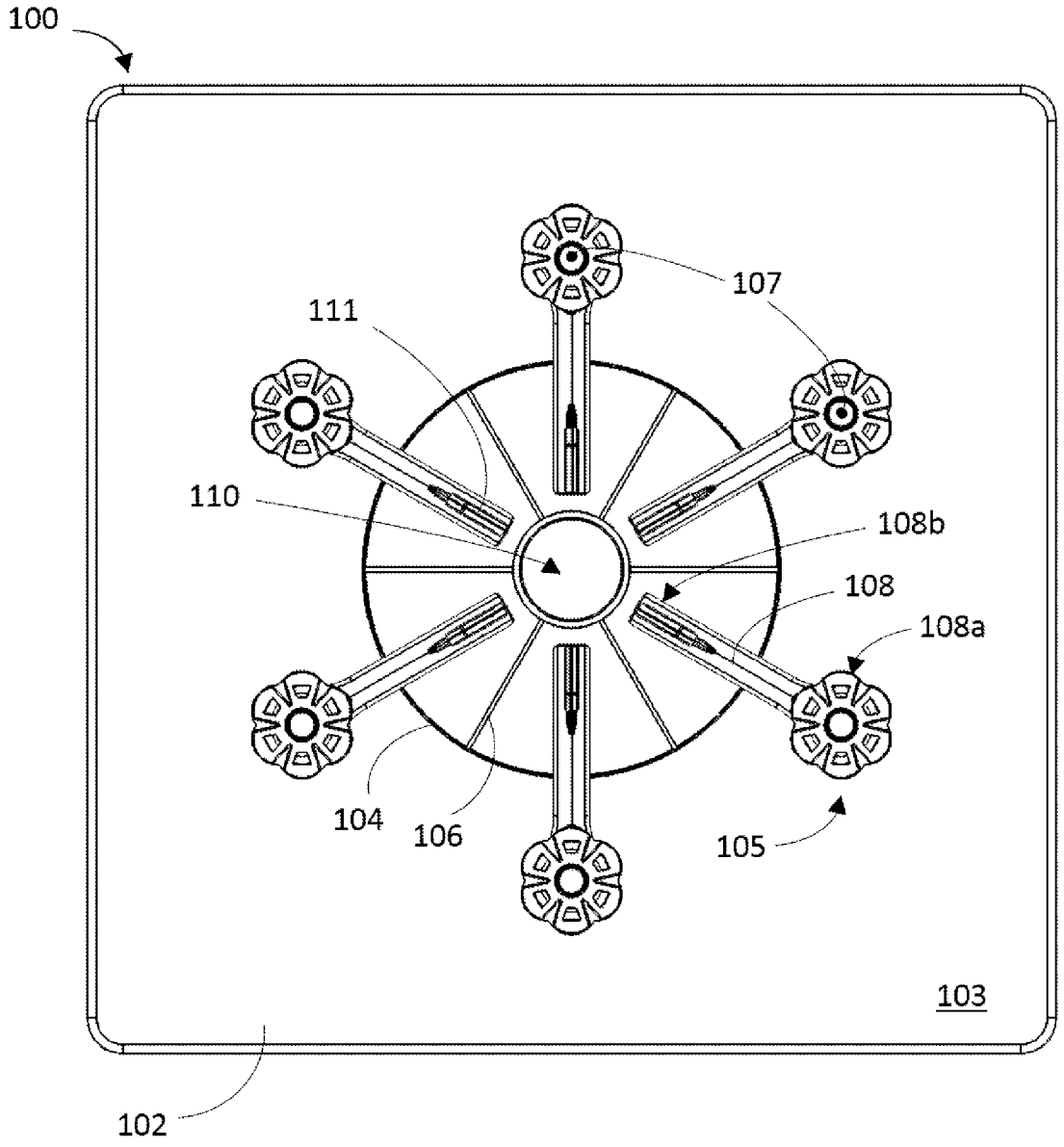
FIG. 1 is a top plan view of an artificial flower maker according to one embodiment of the present disclosure.

The description that follows describes, illustrates and exemplifies one or more embodiments of the invention in accordance with its principles. This description is not provided to limit the invention to the embodiment(s) described herein, but rather to explain and teach the principles of the invention in order to enable one of ordinary skill in the art to understand these principles and, with that understanding, be able to apply them to practice not only the embodiment(s) described herein, but also any other embodiment that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a more clear description. Additionally, the drawings set forth herein are not necessarily drawn to scale, and in some instances proportions may have been exaggerated to more clearly depict certain features. As stated above, this specification is intended to be taken as a whole and interpreted in accordance with the principles of the invention as taught herein and understood by one of ordinary skill in the art.

Turning to FIG. 1, in various embodiments of the present disclosure, a flower maker 100 comprises a board 102 having a generally flat upper surface 103 on which the artificial flower material is placed. In one embodiment, the surface 103 includes an indented circular shape 104 outlining where the material for the artificial flower should be generally placed. The indented circular shape 104 further includes section lines 106 that indicate where to generally place each petal while constructing the artificial flower. A small center hole 110 is located in the center of flat surface 103 for a securing device, such as a center attachment mechanism, for the artificial flower maker. In an alternative embodiment, the center hole 110 may be replaced with a center notch in the flat surface 103 of the flower maker 100.

A plurality of arms 108 is disposed on the flat surface 103 of the flower maker 100 and each arm is preferably identical in shape and structure. Each arm 108 has a distal end 108*a* secured to the flat surface 103 of the flower maker 100 and an unattached, moveable proximal end 108*b*. In the default position, as depicted in FIG. 1, the proximal end is closer to the center of the flat surface 103 than the distal end 108*a*. In certain embodiments, such as the embodiment depicted in FIG. 1, the arm includes a decorative member 105 such as a flower or any other shape that may be appealing to children. In this embodiment, the decorative member 105 is attached to the distal end 108*a* of the arms 108. As further depicted in FIGS. 1-3, in certain embodiments, each arm may also include a gripping member 111 located near the proximal end 108*b* of the arm 108. The shape and construction of each arm 108 or decorative member 105 may be altered to look more appealing to children. For example, the arms may include other decorative elements or may be in different colors.

Figure 2:
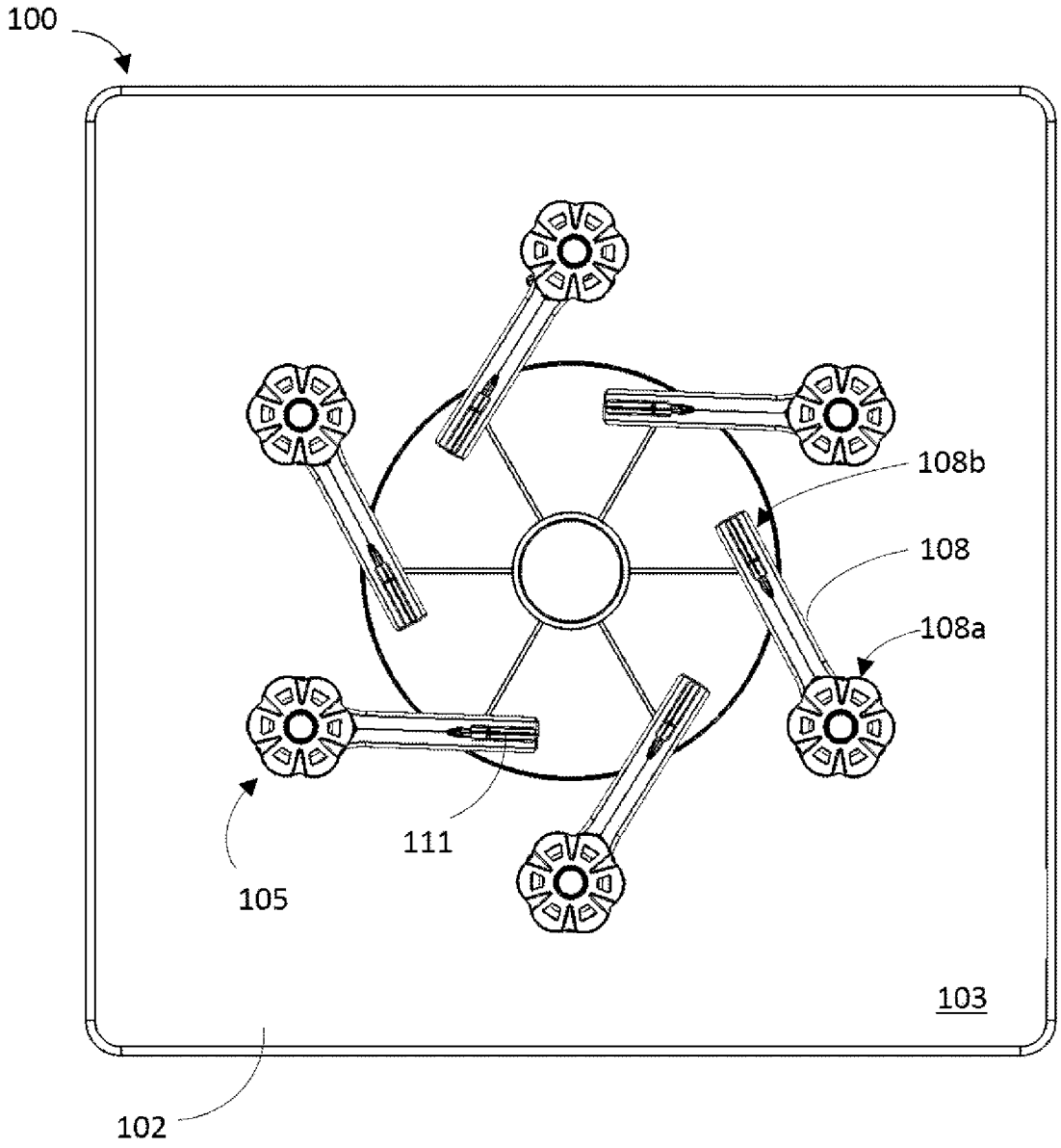
FIG. 2 is a top plan view similar to FIG. 1 with the arms of the flower maker in a second operative position.

As seen in FIGS. 1 and 2, the distal end 108*a* of each of the plurality of arms are disposed about the small circular center hole 110 of the flat surface 103 in a generally circular pattern. In the depicted embodiment the artificial flower maker 100 includes six arms 108, each at the vertices of a hexagon shape. In another embodiment, the artificial flower maker may include five arms, each at the vertices of a pentagon shape. The distal end 108*a* of each arm 108 is attached to the flat surface 103 such that the proximal end 108*b* of each arm 108 is rotatable about an axis of rotation 107. The axis of rotation 107 is located at the distal end 108*a* of each arm 108 and each arm 108 is rotatable about its axis 107 horizontally along the plane of the flat surface 103. The proximal end 108*b* of each arm 108 is also vertically movable relative to the flat surface 103. The arms are preferably formed of a bendable material such that the proximal end 108*b* of each arm 108 may be lifted up (release mode) or down (hold mode) by means of gripping member 111. This material returns to its original state when it is no longer lifted, such that it is biased to the hold mode.

By way of example, each arm 108 may be formed of a spring metal material such that the proximal end 108*b* is vertically movable away from surface 103 by means of a gripping member 111 and spring biased towards surface 103 so as to hold or engage the fabric in place during the design process. Tension springs (not shown) may also be used to bias the arm to the default position of the proximal end 108*b* of the arm 108 in the down or hold mode, and the proximal end 108*b* of the arm 108 is moveable (release mode) due to the tension spring.

Figure 3:
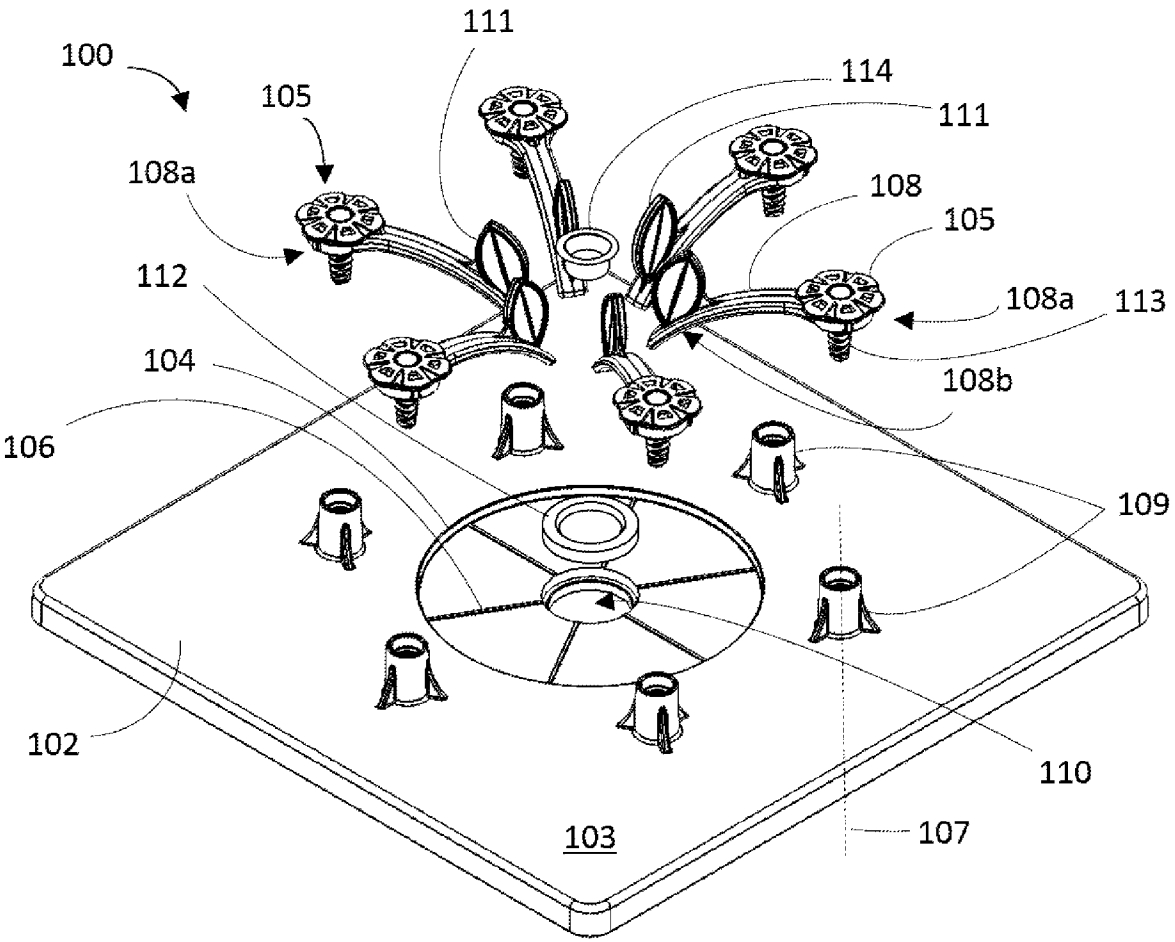
FIG. 3 is an exploded perspective view of the artificial flower maker of FIG. 1.

As depicted in FIG. 3, the distal end 108*a* of each arm 108 is attached to the flat surface 103 by means of a securing device 109. In the depicted embodiment, the securing devices 109 are threaded bosses extending upward from the surface 103 of the board 102 such that a screw 113 at the distal end 108*a* of each arm is screwed into the securing device 109 to attach the arm 108 to the board 102. It should be appreciated that other means of securing the arms 108 to the flat surface 103 could be used.

In addition to the board 102 and the plurality of arms 108, the artificial flower maker 100 includes a center attachment mechanism consisting of a washer 112 and a snap bushing 114. In one embodiment, as will be described in greater detail below, washer 112 is placed in the circular center hole 110 of the board before initiating construction of the artificial flower, and the snap bushing 114 is utilized after the individual petals are constructed to secure the washer 112 and the individual petals together to form the artificial flower. The entire fabric flower 700 can be held together by any suitable center attachment mechanism, and it will be understood that this center attachment mechanism can be designed in many different ways and have different shapes. Glue may be used to join the fabric pieces along with a central gem, button, felt, or fabric piece. In other embodiments, the flower petals are stitched together with a needle and thread, or alternatively a screw, some washers and a nut may be used to hold the folded petals together. In another embodiment, a mini-rivet type device can be used to forcibly snap the petals together. These are only examples and are not meant to be exhaustive of the way to join the petals together through a center attachment mechanism.

The dimensions of the flower maker 100 may vary for different embodiments of the present disclosure. In one example embodiment, the board dimensions are 5.3125 inches by 5.4375 inches by 0.25 inches. In this example embodiment, the washer 112 or outer ring has an inside diameter of 0.625 inches, an outside diameter of 0.875 inches, and a height of 0.25 inches. In this embodiment, the snap bushing 114 used to secure the flower together has a 0.5 inches diameter.

Figure 4:
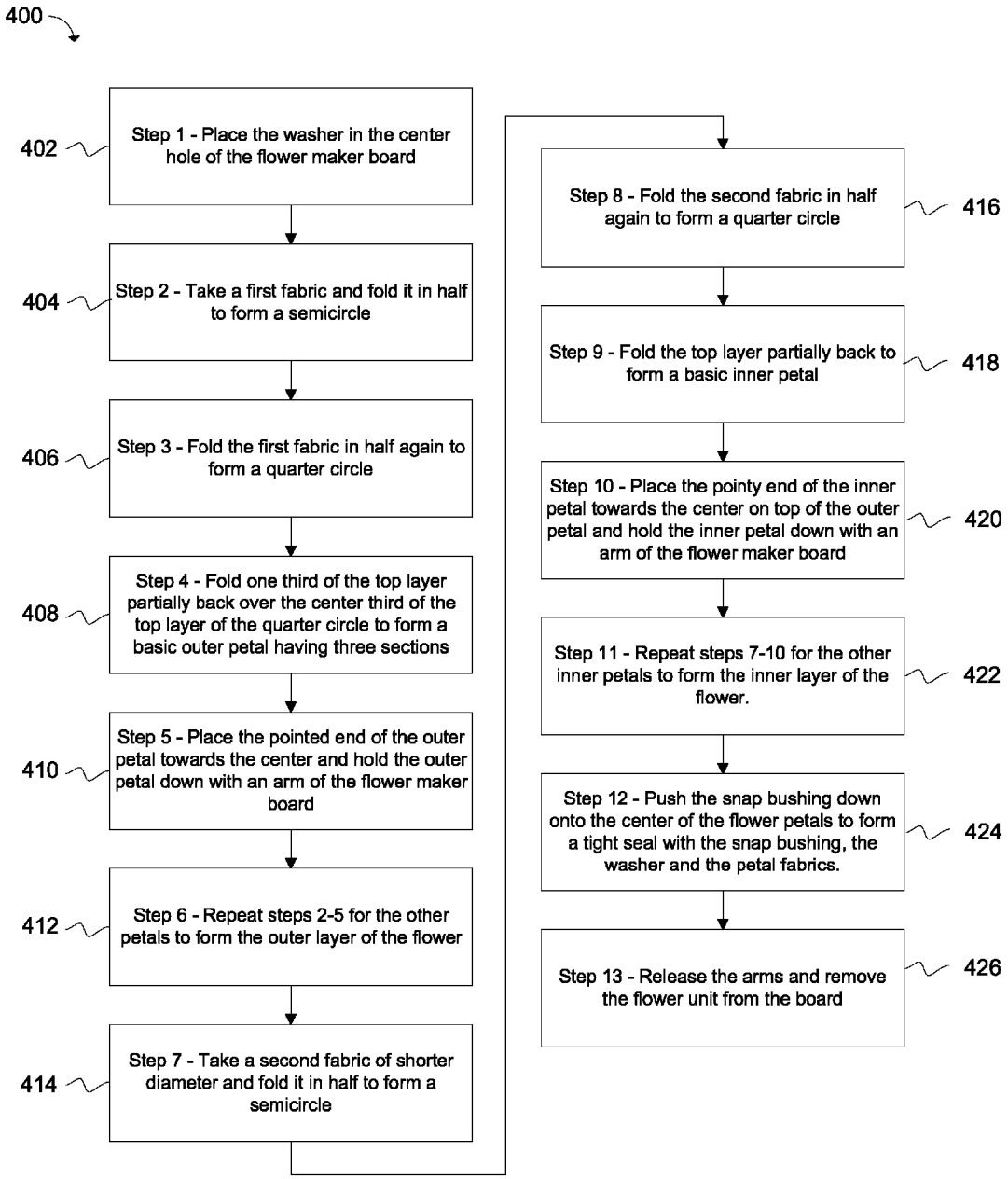
FIG. 4 is a flow chart of a process of constructing and securing a flower using an artificial flower maker according to one embodiment of the present disclosure.

FIGS. 4 and 5A-5K illustrate the process of constructing and securing an artificial flower using the artificial flower maker in one example embodiment. FIG. 4 is a flow chart illustrating an exemplary process 400 of constructing an artificial flower. For this example embodiment, the artificial flower is made of fabric petals. It should be appreciated that in certain embodiments of the present disclosure, an artificial flower may include one layer of petals. Other alternative embodiments of the present disclosure include multiple layers of petals. In this example embodiment, the entire flower 700 is constructed with two layers of fabric petals. The petals 500*d*, 520, 530, 540, 550 and 560 in the first layer are referred to as the outer petals and the petals 600, 602, 604, 606, 608 and 610 in the second layer are referred to as the inner petals. In this embodiment, pieces of fabric 500 used to form each petal have a generally circular shape with each outer petal fabric piece having a first diameter and each inner petal fabric piece having a second diameter, where the first diameter is greater than the second diameter. For example, the first diameter for the example process below is 3 inches, and the second diameter is a 2.25 inches. In this embodiment, each petal fabric piece for this first layer of the artificial flower has the same diameter.

Figure 5A:
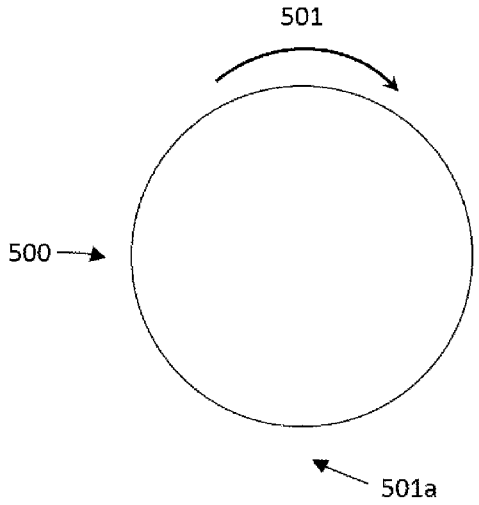
FIGS. 5A-5D are representational views of a piece of fabric in different states of folding to illustrate the steps of constructing and securing a flower according to one embodiment of the present disclosure.
Figure 5B:
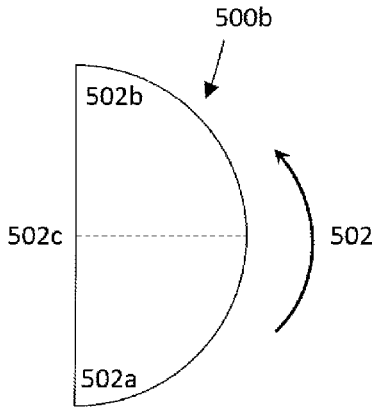

Turning to FIG. 4, the exemplary process 400 begins with the first step as indicated by block 402, which is to place the washer 112 in the notch or center hole 110 of the flower maker board 102. FIG. 5A depicts the first piece of fabric 500 having a circular shape. As indicated by the arrow 501 in FIG. 5A, and as indicated by block 404, step two of the process 400 includes taking a first piece of fabric 500, and folding it in half along its center line 501*a* to form a semicircle 500*b*, as depicted in FIG. 5B. The semicircle of fabric 500*b* has a first end 502*a* and a second end 502*b*. As indicated by block 406, and as depicted in FIG. 5B, step three of the process 400 includes folding the semicircle 500*b* of the first fabric piece 500 in half again by folding the first end 502*a* towards the second end 502*b* of the semicircle over a center line 502*c* of the semicircle 500*b*, as indicated by arrow 502.

Figure 5C:
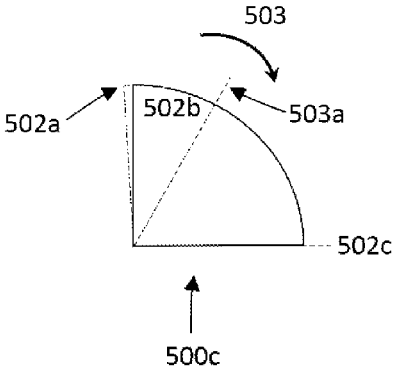

Turning to FIG. 5C, the fabric piece 500 is now folded into a quarter circle 500*c* with the first end 502*a* of the previous semicircle 500*b* directly on top of the second end 502*b*. The quarter circle of fabric 500*c* includes a bottom quarter circle layer of fabric including the first end 502*b*, and a top quarter circle layer of fabric including the second end 502*a*, which is covering the bottom layer entirely. The dotted line 503*a* indicates the next fold line representing approximately one third of the quarter circle 500*c*. As indicated by block 408 and as depicted in FIG. 5C, step four of the process 400 includes folding the top end 502*b* of the quarter circle of fabric 500*c* partially back towards the center line 502*c* over the one third fold line 503*a* to form the first basic outer petal 500*d*. More specifically, in this example embodiment, step four includes taking approximately one third of the top layer of the quarter circle 500*c* including the top end 502*b* and folding it backwards over the one third fold line

503*a* towards the center line 502*c* of the previous semicircle 500*b*, in the direction of the arrow 503.

Figure 5D:
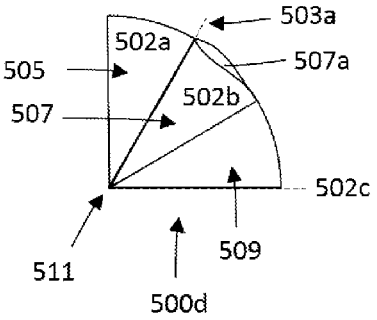

As depicted in FIG. 5D, after completing step four, the now-folded quarter circle of fabric 500*d* has three separate sections, and each section is approximately one third of the quarter circle 500*c*. Section 505, approximately one third of the bottom quarter circle layer including the first end 502*a* of the previous semicircle 500*b*, is visible. Section 507 is approximately one third of the top quarter circle layer including the second end 502*b* of the previous semicircle 500*b*. It should be appreciated that section 507 includes three layers of the quarter circle 500*c* (the center third of the bottom layer of the quarter circle 500*c* at the very bottom, the center third of the top layer of the quarter circle 500*c* above that, and at the very top is the previously leftmost third of the top layer of the quarter circle 500*c* flipped backwards over the one third fold line 503*c* so that the end 502*b* is now closer towards the center line 502*c* of the previous semicircle 500*b*). The bubble type shape 507*a* represents the fold from the top layer of the quarter circle 500*c*. Section 509 is approximately one third of the right-most section of the top quarter circle layer bordering on the centerline 502*c* of the previous semicircle 500*b*. The point formed by the folded quarter circle 500*d* depicted in FIG. 5D is the pointed end 511.

Figure 5E:
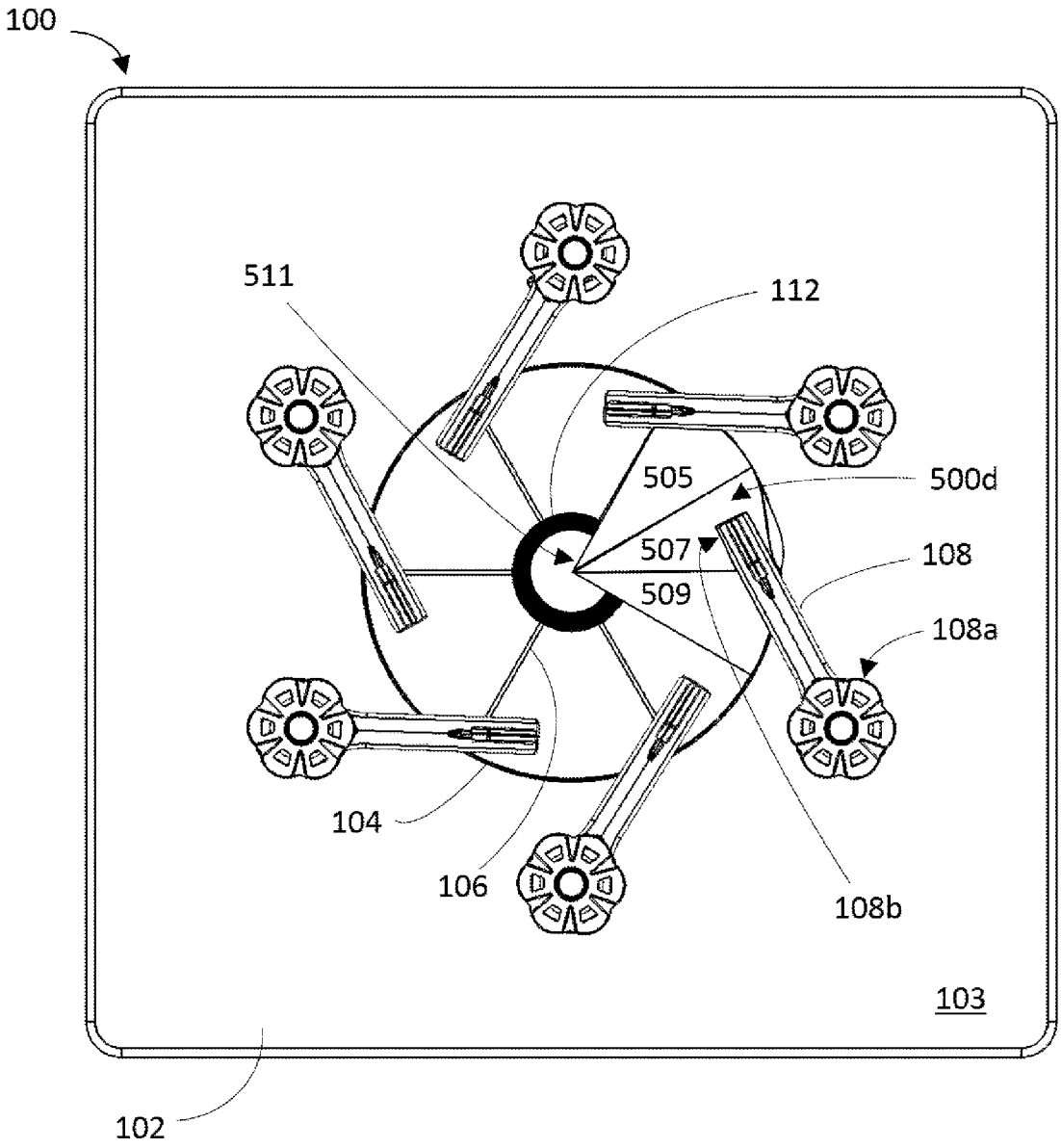
FIGS. 5E-5J are top plan views of the flower maker board as shown in FIG. 1 with the fabric in various states of assembly.

Turning back to FIG. 4, as indicated by block 410, step five of the process 400 includes placing the first petal on the board by placing the pointed end 511 of the outer petal 500*d* towards the center hole 110 of the flat surface 103 and holding the outer petal down with one of the arms 108 of the flower maker 100. As depicted in FIG. 5E, in this embodiment, the washer 112 is placed in the center of the board 102. The flower petal 500*d* is placed on the board so that the pointed end 511 of the flower petal 500*d* hangs over the center hole 110 at the center of the board 102, thereby covering part of the washer 112. An arm 108 of the flower maker 100 is used to hold the flower petal 500*d* down. The user may lift up the arm 108 by lifting the gripping member 111 at the proximal end 108*b* of each arm and the user slips the flower petal between the board 102 and the arm 108. In other embodiments, the user may press down on the distal end 108*a* of the arm so as to lift the moveable proximal end 108*b* of the arm up.

Figure 5F:
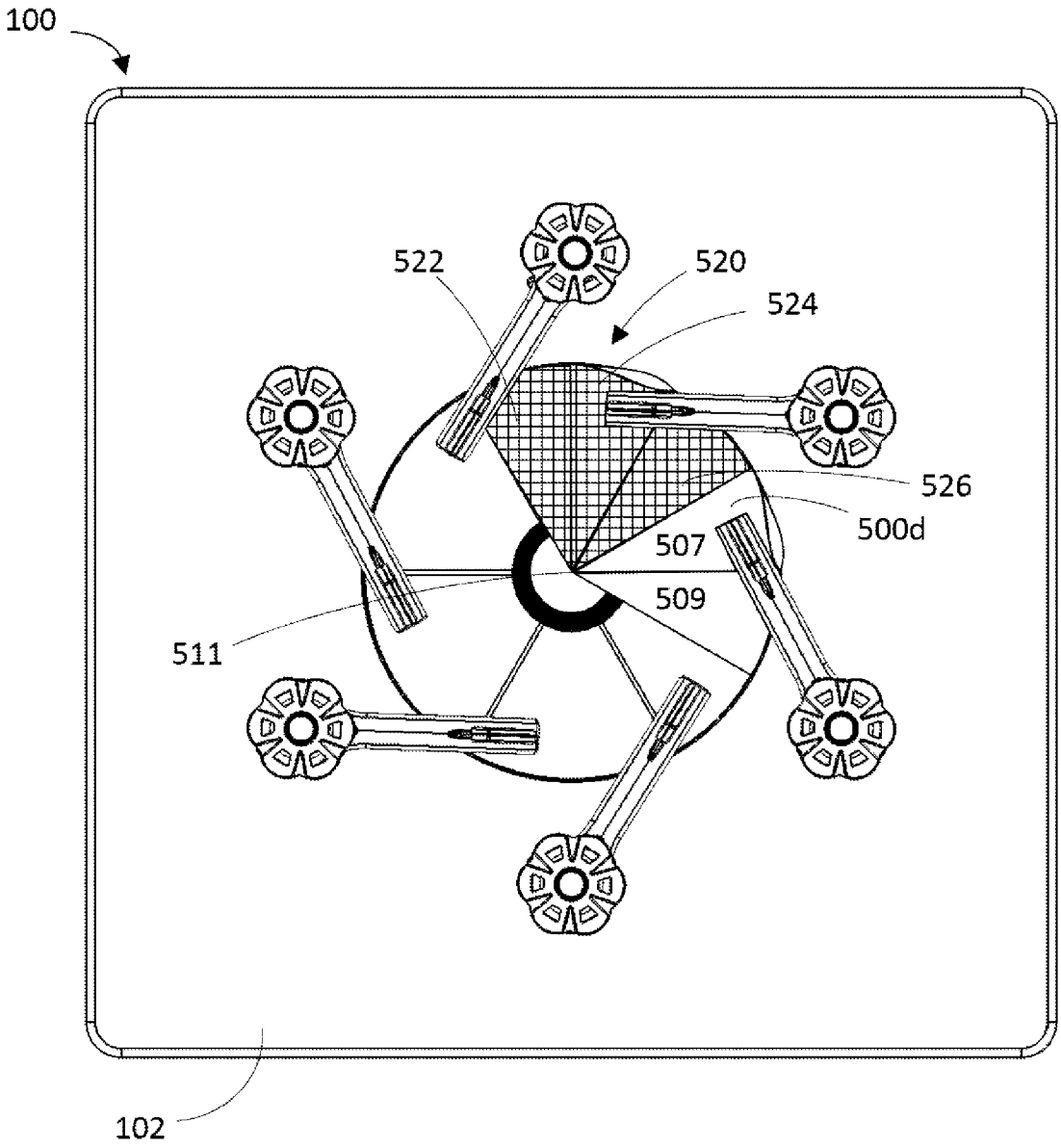
Figure 5G:
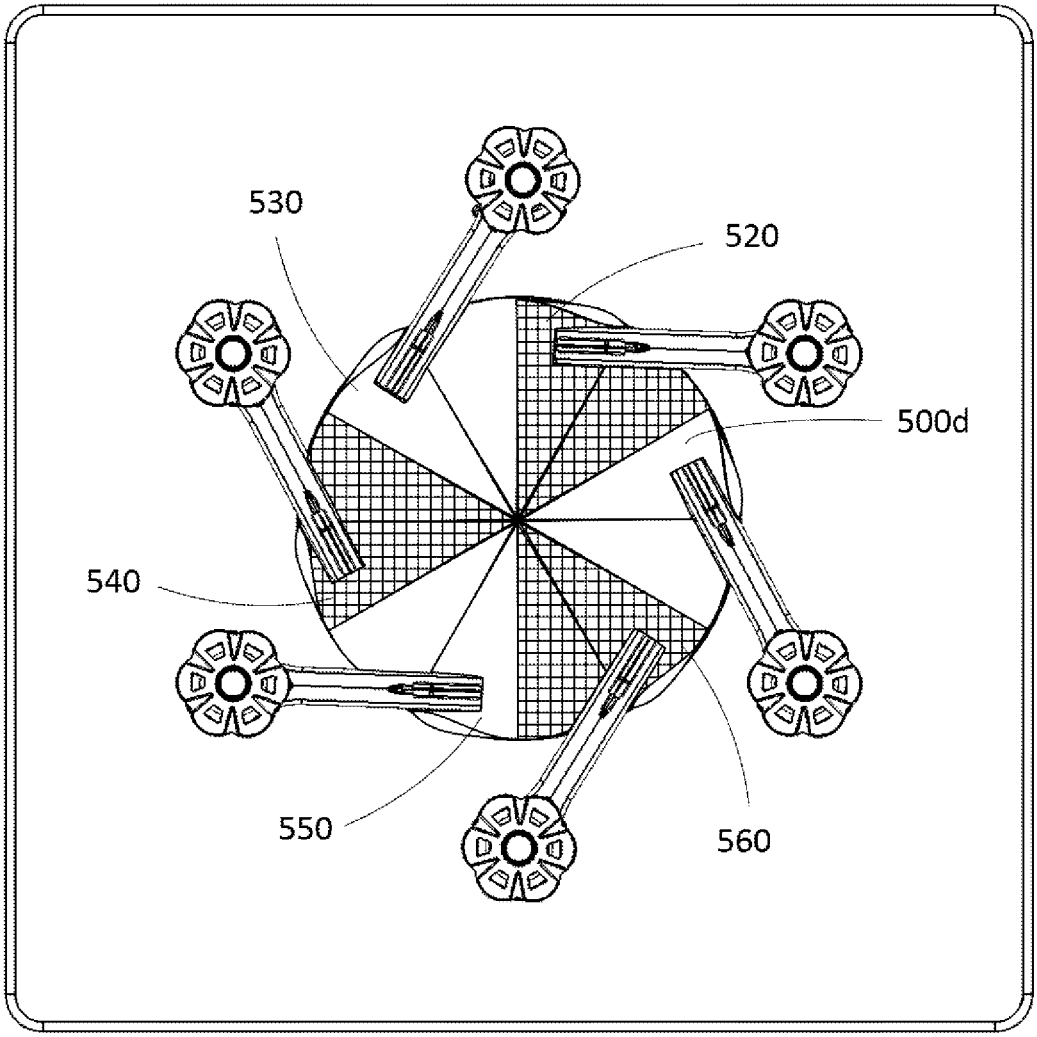

Turning to FIG. 5F, for each subsequent petal of the artificial flower, the process 400 includes repeating steps two through five, as indicated by block 412 and as depicted in FIGS. 5F and 5G ultimately forming petals 520, 530, 540, 550 and 560. As depicted in FIG. 5F, the cross hatching of petal 520 is indicative of a different piece of fabric material only.

It should be appreciated that petal 520 includes three sections 522, 524, and 526, each of which is similar to the three sections of petal 500*d* as described with respect to FIG. 5D. It should also be appreciated that each subsequent flower petal is placed such that one third of the subsequently placed flower petal is placed overtop one third of the previously placed flower petal. More specifically, as depicted in FIG. 5F, section 526 of flower petal 520 is placed overtop of section 505 of flower petal 500*d*.

Turning to FIG. 5G, after each of the petals have been placed on the board, only two sections of each petal are visible and one third of each flower petal is covered by an adjacent flower petal. As depicted in FIG. 5G, each flower petal is held down by a different arm 108 of the flower maker 100. It should further be appreciated that after all flower petals of the outer layer of the fabric flower are placed on the board, the washer 112 and the center hole 110 of the board are no longer visible.

In an embodiment including a second layer of flower petals, such as this example embodiment, a second inner layer of petals are constructed in the same manner as the petals in the first, outer layer. In this embodiment, each petal of the inner layer of petals has a diameter that is less than the diameter of the outer layer petals. The inner layer petals are each folded in the same manners as the outer layer petals. Turning back to FIG. 4, to construct the inner layer of flower petals, step seven of the process 400 includes taking a second fabric of shorter diameter less than the first fabric and folding it in half to form a semicircle, as indicated by block 414. Step eight of the process 400 includes folding the second fabric in half again to form a quarter circle, as indicated by block 416, and step nine includes folding approximately one third of the top layer of the quarter circle partially back to form a basic inner petal, as indicated by block 418.

Figure 5H:
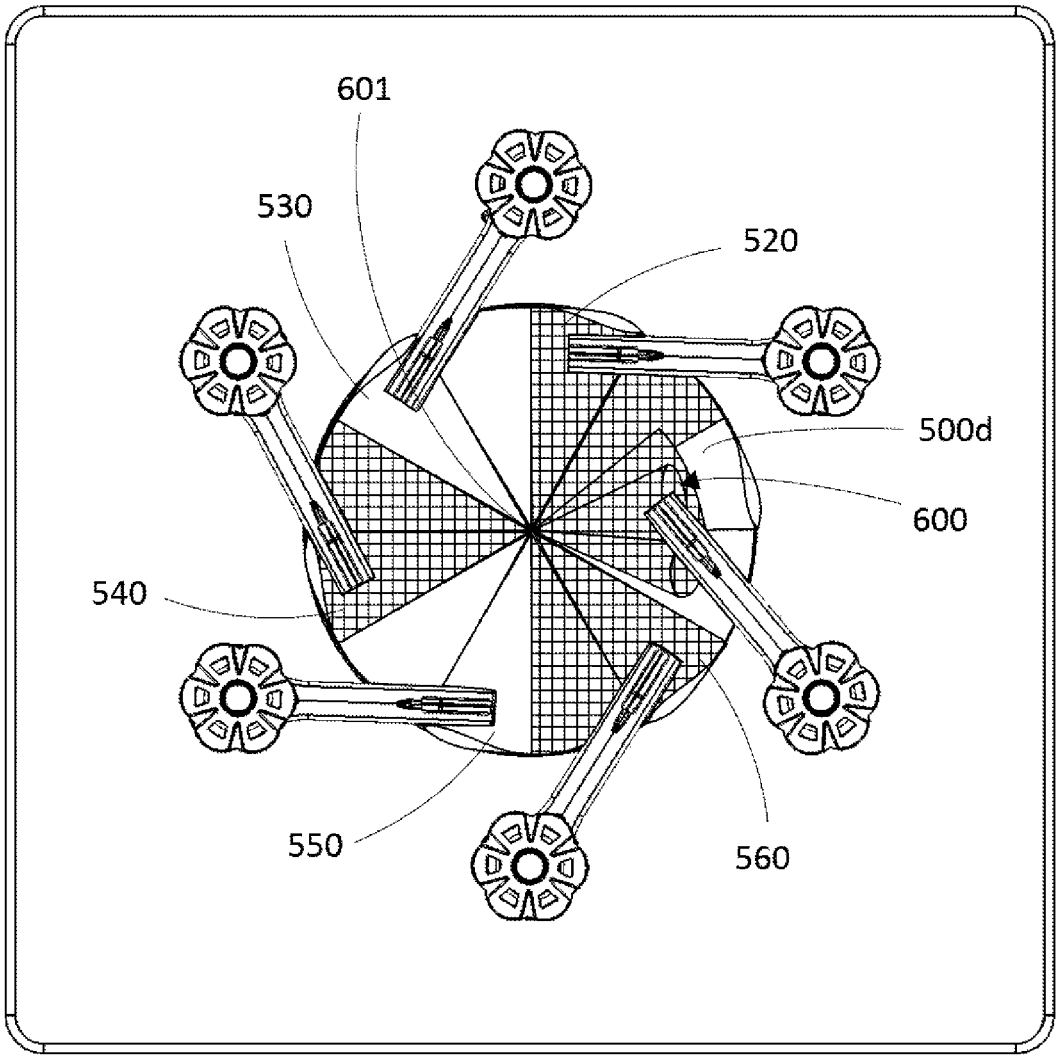
Figure 5I:
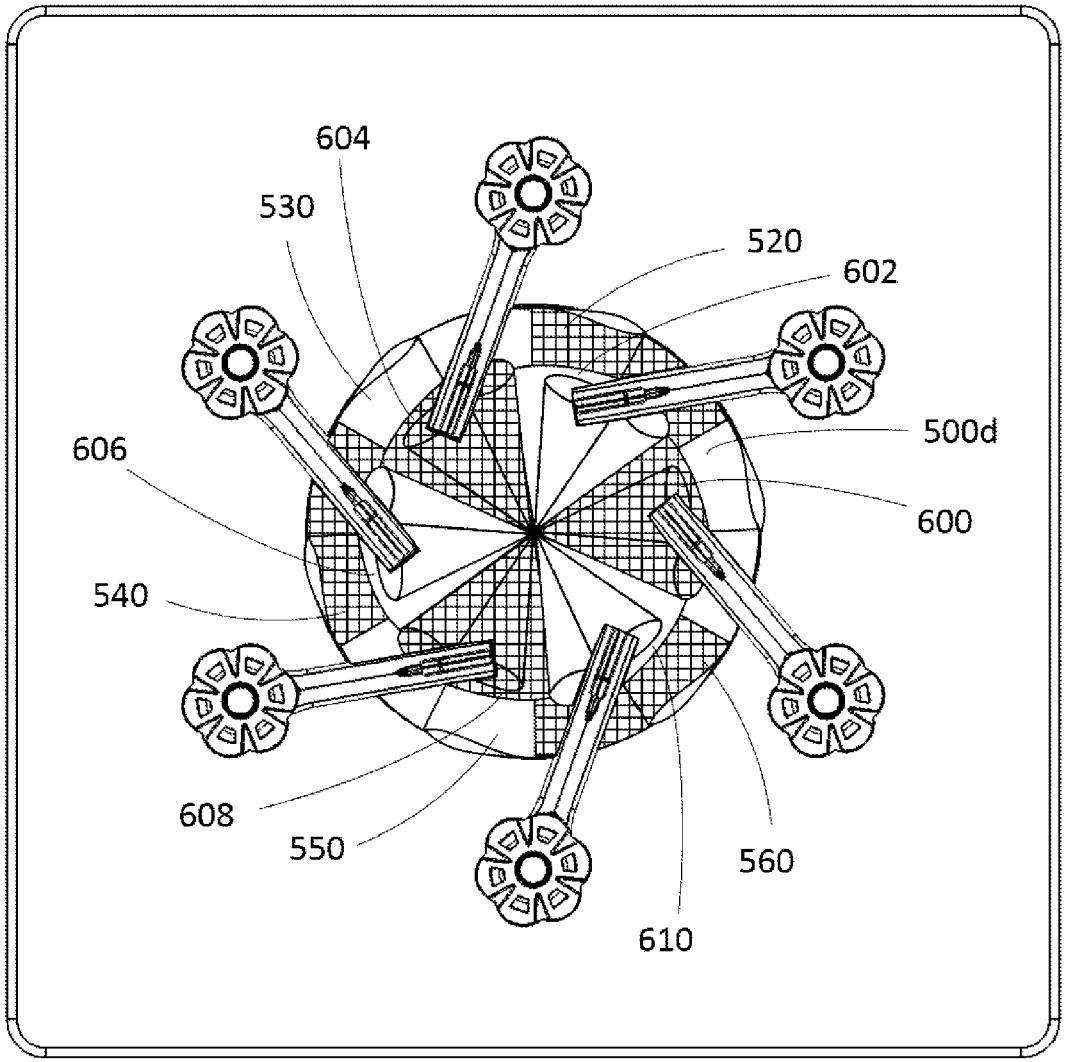

After the inner flower petal 600 is constructed, step ten of the process 400 includes placing the inner flower petal 600 on the board 102 by placing the pointy end 601 of the inner petal 600 towards the center of the board on top of the outer petal 500*d* and holding the inner petal 600 down with an arm 108 of the flower maker board 102, as indicated in block 420. More specifically, as depicted in FIG. 5H, the inner layer petal 600 is placed on top of the outer layer petal 500*d* and the arm holding the outer layer petal 500*d* is lifted and placed back on top of both the inner 600 and outer 500*d* layer petal. Step eleven of the process 400, then includes repeating steps 7-10 for each of the other inner petals to form the inner layer of the flower, as indicated by block 422. As depicted in FIG. 5I, each of the inner petals 600, 602, 604, 606, 608 and 610 are placed on top of each outer petal 500*d*, 520, 530, 540, 550, and 560, respectively. Similar to the petals in the outer layer, each petal in the inner layer is placed so that it overlaps a portion of the previously placed flower petal.

Figure 5J:
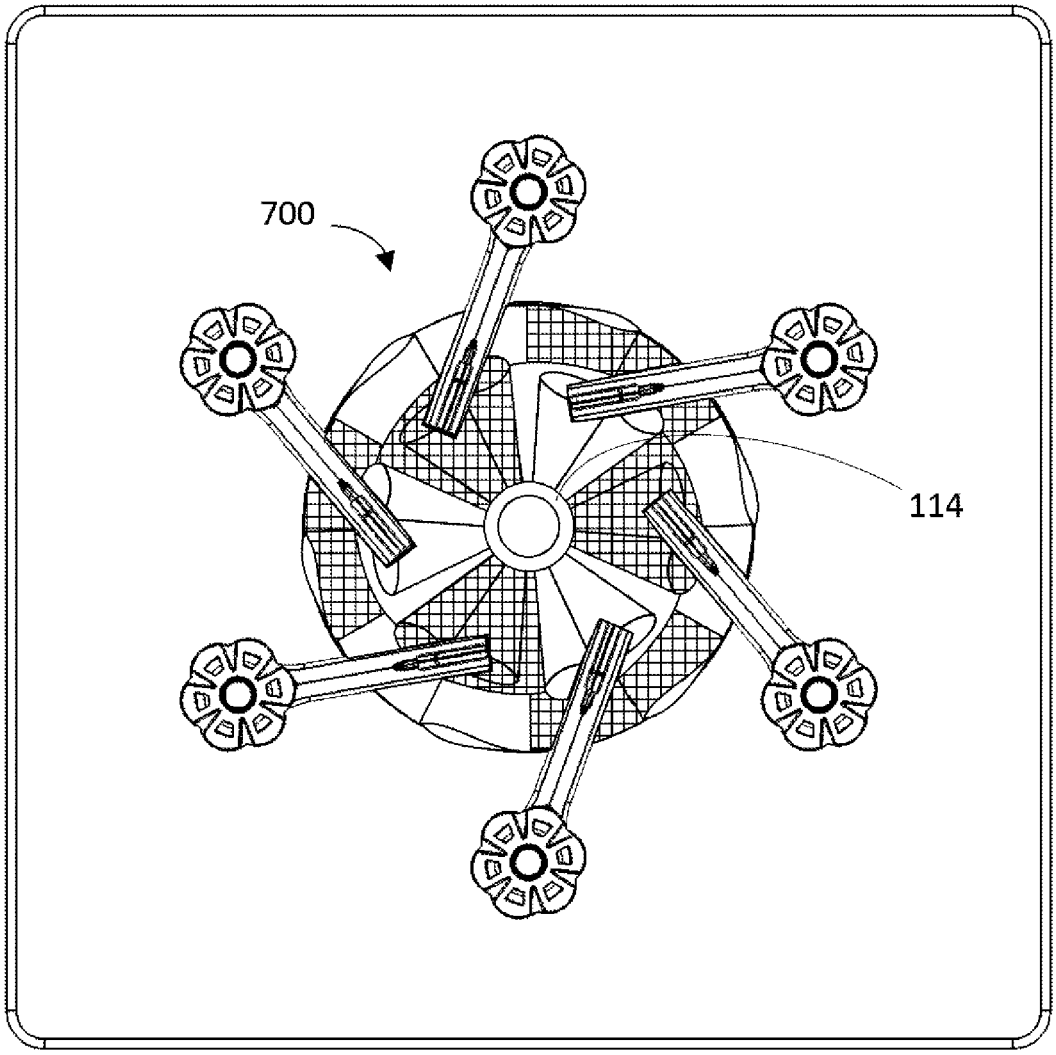
Figure 5K:
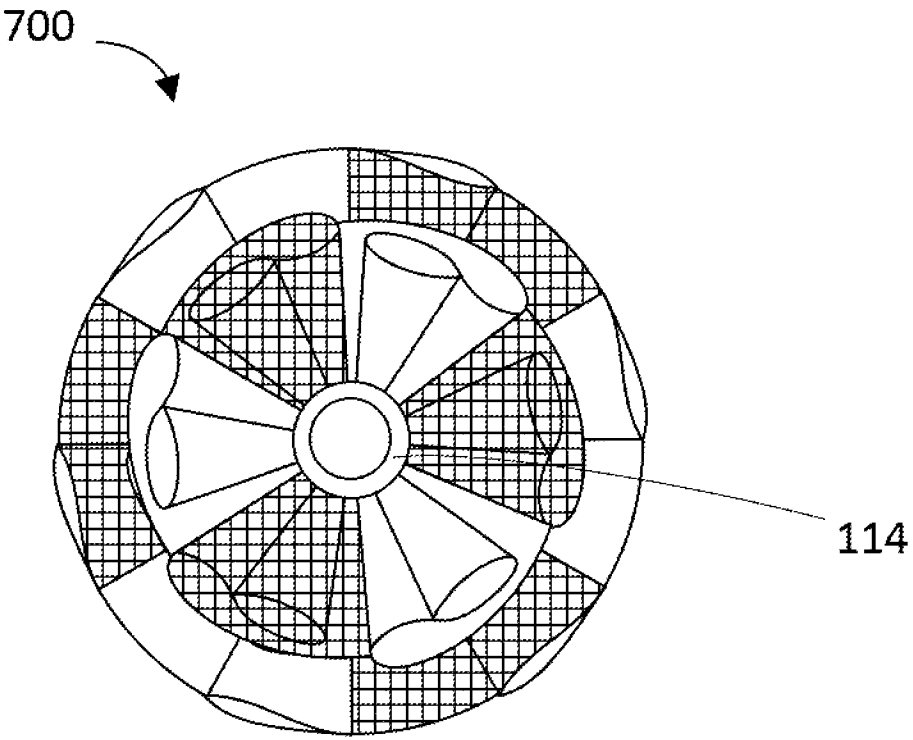
FIG. 5K is a top plan view of a fabric flower constructed in accordance with one embodiment.

After each of the flower petals for the artificial flower is constructed, step twelve of the process 400 includes securing the artificial flower, as indicated by block 424. To do so, the process 400 includes pushing the snap bushing 114 down onto the center of the flower petals, through the center hole 110, to form a tight seal with the snap bushing 114, the washer 112 (or outer ring) and the petal fabrics, as indicated by block 424 and as depicted in FIG. 5J. Once the entire flower 700 is constructed and secured, the final step of the process 400 includes releasing the arms and removing the flower unit 700 from the board, as indicated by block 426 and as depicted in FIG. 5K.

Figure 6:
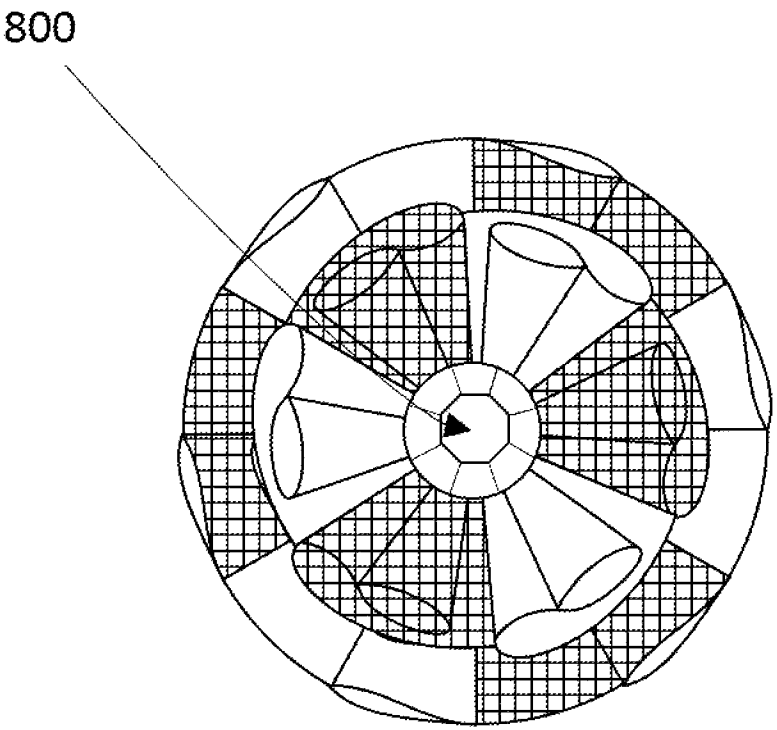
FIG. 6 is a top plan view of an artificial flower constructed in accordance with an example alternative embodiment.

In various embodiments of the present disclosure, the center attachment mechanism can be designed in many different ways. It should be appreciated that in the example described above, the washer 112 or outer ring and the snap bushing 114 are used to snap the fabric flower in place. A different inner ring may be used in conjunction with the washer 112 to secure the flower. In certain embodiments, as depicted in FIG. 6, the snap bushing 114 has a central gem 800 attached to it so that the center of the flower 700 includes a decorative gem. In other alternative embodiments, the central gem can be replaced with a button, felt, or fabric piece. It should also be appreciated that the flower petals may be attached in various different ways. In other embodiments, a screw, some washers and a nut are used to hold the folded petals together. In another embodiment, a mini-rivet type device can be used to forcibly snap the petals together.

Figure 7:
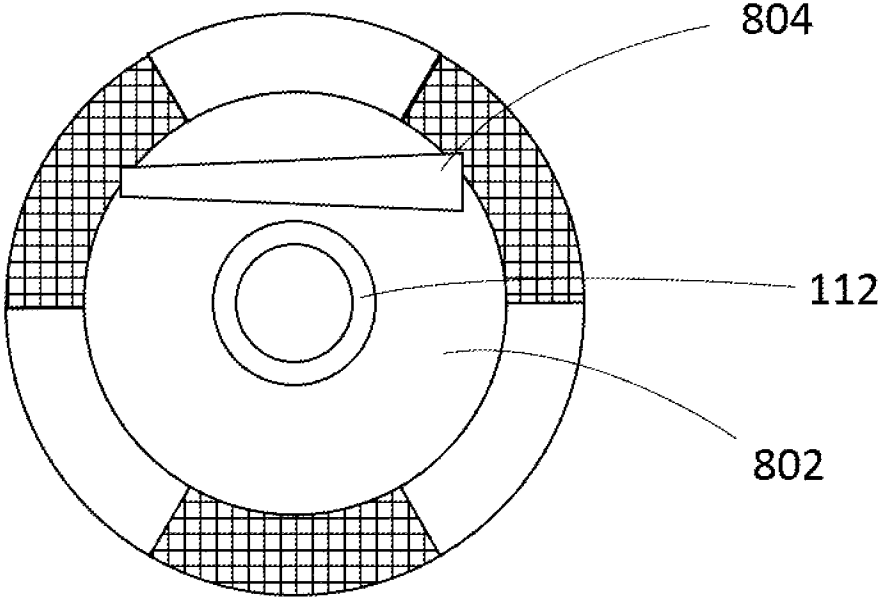
FIG. 7 is a rear view of an artificial flower manufactured according to an example alternative embodiment.

The artificial flower can also be used decoratively and can be modified to be displayed, worn on an article of clothing or as an accessory in hair, or decoratively attached to objects such as pillows, hats, bags, shoes, curtains, etc. For example, FIG. 7 illustrates the back of an exemplary artificial flower 700 where a piece of felt 802 is glued to the back of artificial flower 700. In this embodiment, a metal clip 804 is then attached to the felt 802 on the back of the artificial flower 700 so that the flower 700 can be clipped onto an article of clothing, or as an accessory clipped in a user's hair. It should be appreciated that the piece of felt can be replaced by any other piece of material or can be eliminated altogether. It should further be appreciated that instead of the metal clip 804, a safety pin, hook and loop tape or any other device used to fix the flower to another object may be used.

Figure 8:
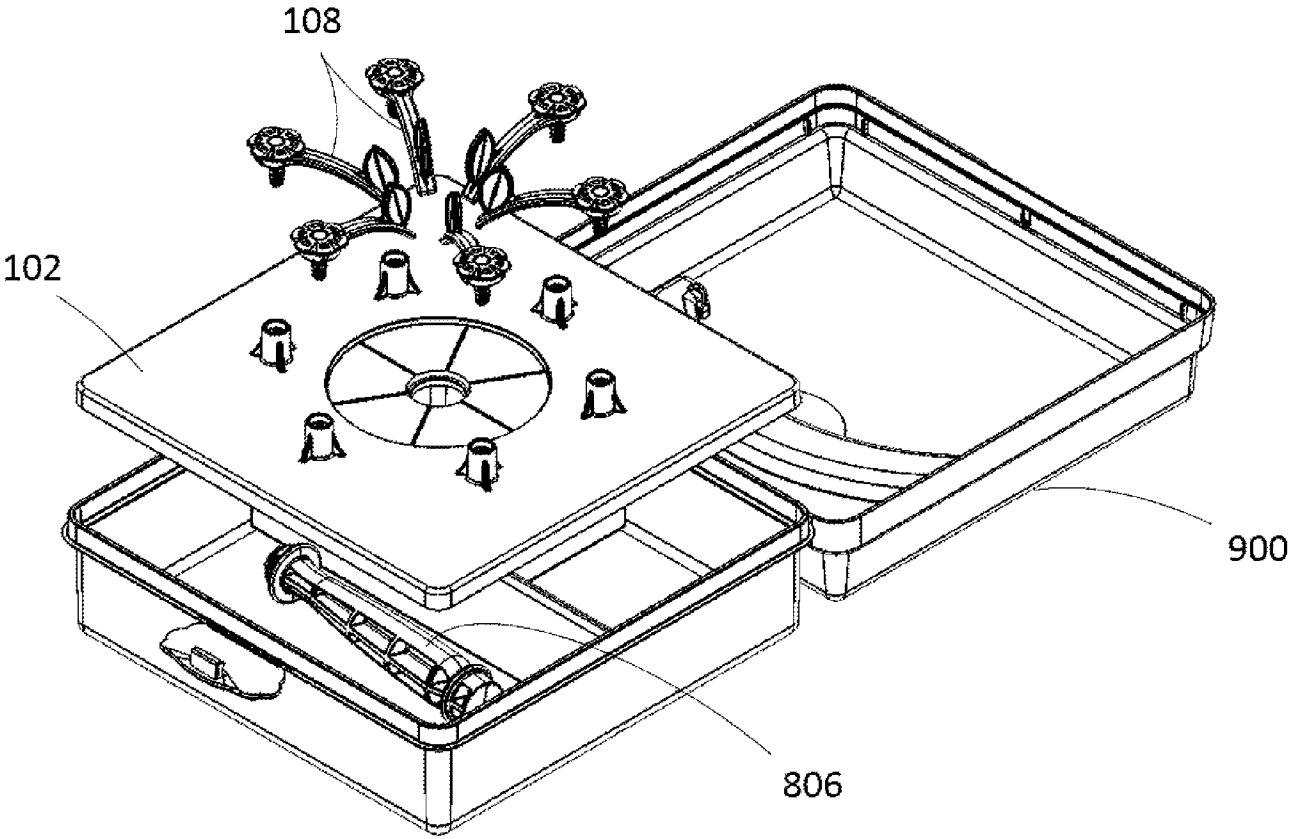
FIG. 8 is an exploded perspective view of an alternative embodiment incorporating a carrying case for an artificial flower maker.
Figure 9:
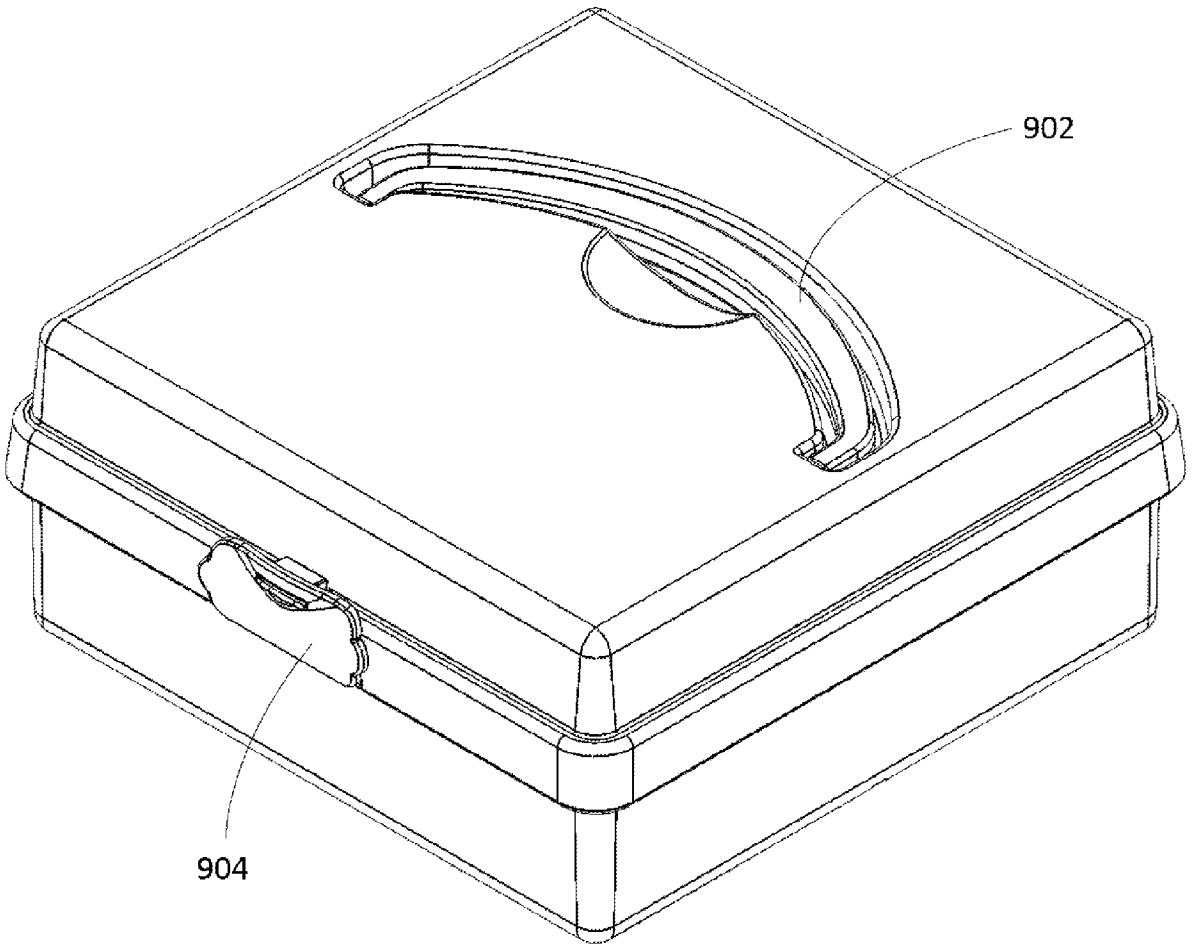
FIG. 9 is a perspective view of the carrying case of FIG. 8 in the closed position.

FIGS. 8 and 9 illustrate one example embodiment in which the entire artificial flower maker is contained within a carrying case 900. As seen in FIG. 8, in one embodiment of the present disclosure, a joining apparatus 806, which facilitates pushing the snap busing 114 into the washer 112 to secure the artificial flower may be included. The final step of joining the flower petals together may be difficult for children and thus, the joining apparatus 806 is included to make it easier for children to fit the final pieces together. The exemplary joining apparatus 806 depicted in FIG. 8 is an oblong shape and includes ribs exposing the hollow interior and one end of the joining apparatus 806 is shaped to fit with the snap bushing 114 so as to facilitate pushing the snap bushing 114 into the washer 112 to secure the flower petals. It should be appreciated that the joining apparatus may be in any other shape or form including an end shaped to fit with the attachment mechanism for the flower maker. It should be appreciated that this is just one example of a joining apparatus 806 and a carrying case 900 for the artificial flower maker 100 and that both the joining apparatus 806 and the carrying case 900 may be designed with a different shape or with different dimensions.

It should also be appreciated that in another embodiment, the carrying case 900 may be circular in shape and may use a circular board instead of a square board as depicted in the figures above. In one embodiment, the case 900 holds the entire flower maker 100, including the board 102, the arms 108, and the supplies for constructing the artificial flower including pieces of precut material (i.e., such as fabric) for the petals, a washer 112, and a snap bushing 114, or any combination thereof. As further depicted in FIG. 9, certain embodiments of the carrying case include a handle 902 and a clasp 904 to close the lock and the box 900.

It should also be appreciated that the above instructions may be given in the form of computer software or application codes or computer software user interface to assist in the making of the artificial flower. In another embodiment, computer applications embodying the instructions above may be implemented in a computing device or a portable computing device. For example, the above instructions may be embodied in a set of interactive instructions that assist or teach users how to make the artificial flower. On the other hand, aspects of the invention may be implemented in an industrialized setting. For example, instructions above may be configured as programming to control mechanical or robotic arms to produce the artificial flowers in large scale.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

The invention claimed is:

1. An artificial flower maker for use with a plurality of pieces of material, the artificial flower maker comprising:

a surface having a center opening;

a plurality of arms disposed about the center opening, each arm having a distal end secured to the surface and a proximal end, wherein the proximal end of each arm is rotatable horizontally about a pivot point and is movable vertically away from the surface, the proximal end of each arm being capable of securing at least one of the plurality of pieces of material to the surface;

an attachment mechanism that fits within the center opening capable of securing together each of the plurality of pieces of material to form an artificial flower.

2. The artificial flower maker of claim 1, wherein the pivot point comprises a plurality of separate pivot points, each of the plurality of separate pivot points corresponding to one of the plurality of arms, and the separate pivot point of each arm is located at the distal end of the arm.

3. The artificial flower maker of claim 1, wherein each arm is spring biased towards the surface to hold the at least one of the plurality of pieces of material to the surface.

4. The artificial flower maker of claim 1, wherein the attachment mechanism comprises a washer and a snap bushing.

5. The artificial flower maker of claim 4, wherein the snap bushing includes a decorative element.

6. The artificial flower maker of claim 1, further comprising a board on which the surface is formed, wherein the center opening extends through the board.

7. The artificial flower maker of claim 6, further comprising an enclosure, wherein the board may be removably disposed in the enclosure.

8. An artificial flower maker kit, comprising:

a plurality of pieces of material, wherein the plurality of pieces of material are used with a flower maker board, the flower maker board comprising a surface having a center opening, a plurality of arms disposed about the center opening, each arm having a distal end secured to the surface and a proximal end, wherein the proximal end of each arm is rotatable horizontally about a pivot point and is movable vertically away from the surface, the proximal end being capable of securing at least one of the plurality of pieces of material to the surface; and an attachment mechanism connected to the center opening for securing each of the plurality of pieces of material together.

9. The artificial flower maker kit of claim 8, wherein the plurality of pieces of material comprise a first plurality of pieces of material, each of the first plurality of pieces of material having a first diameter, and a second plurality of pieces of material, each of the second plurality of pieces of material having a second diameter.

10. The artificial flower maker kit of claim 8, further comprising a joining apparatus for assisting in connecting the attachment mechanism in the center opening to the pieces of material, and an enclosure, wherein the attachment mechanism, the joining apparatus and the plurality of pieces of material may be stored in the enclosure when the flower maker board is not in use.

11. The artificial flower maker kit of claim 8, further comprising an enclosure, wherein the flower maker board may be removably disposed in the enclosure.

12. An artificial flower maker for use with a plurality of pieces of material, the artificial flower maker comprising:

a board having a generally flat first surface and a second surface opposite the first surface, and a center opening;

a plurality of arms disposed about the center opening, each arm having a distal end connected to the first surface and a proximal end, wherein the proximal end of each arm is rotatable horizontally about a pivot point and is movable away from the first surface and biased toward the first surface for securing at least one of the plurality of pieces of material to the first surface;

a connector that fits within the center opening capable of securing together two or more of the plurality of pieces of material to form an artificial flower.

13. The artificial flower maker of claim 12, further comprising a plurality of gripping members, each gripping member being located adjacent to the proximal end of one of the plurality of arms for assisting in moving the one of the plurality of arms away from the first surface.

14. The artificial flower maker of claim 12, wherein the connector comprises a washer and a snap bushing.

15. The artificial flower maker of claim 12, wherein the center opening extends through the board.

16. The artificial flower maker of claim 12, further comprising a plurality of securing structures extending upwardly from the first surface, and wherein the distal end of each arm comprises an extension that extends into one of the plurality of securing structures.

17. The artificial flower maker of claim 12, wherein the pivot point comprises a plurality of separate pivot points, each of the plurality of separate pivot points corresponding to one of the plurality of arms, and the separate pivot point of each arm is located at the distal end of the arm.

18. The artificial flower maker of claim 17, further comprising a plurality of gripping members, each gripping member being located adjacent to the proximal end of one of the plurality of arms for assisting in moving the one of the plurality of arms away from the first surface.

* * * * *